US010883226B2

(12) United States Patent
Vanhatalo et al.

(10) Patent No.: US 10,883,226 B2
(45) Date of Patent: Jan. 5, 2021

(54) PROCESS FOR PRODUCING MICROFIBRILLATED CELLULOSE AND A PRODUCT THEREOF

(71) Applicant: Kemira OYj, Helsinki (FI)

(72) Inventors: Kari Vanhatalo, Espoo (FI); Tom Lundin, Turku (FI); Marcus Lillandt, Ingå (FI)

(73) Assignee: Kemira Oyj, Helsinki (FI)

( * ) Notice: Subject to any disclaimer, the term of this patent is extended or adjusted under 35 U.S.C. 154(b) by 209 days.

(21) Appl. No.: 16/074,562

(22) PCT Filed: Dec. 22, 2016

(86) PCT No.: PCT/FI2016/050916
§ 371 (c)(1),
(2) Date: Aug. 1, 2018

(87) PCT Pub. No.: WO2017/134334
PCT Pub. Date: Aug. 10, 2017

(65) Prior Publication Data

US 2019/0040581 A1 Feb. 7, 2019

(30) Foreign Application Priority Data

Feb. 3, 2016 (FI) ..... 20165074

(51) Int. Cl.
*D21H 11/18* (2006.01)
*D21B 1/04* (2006.01)
*D21B 1/06* (2006.01)

(52) U.S. Cl.
CPC ..... *D21H 11/18* (2013.01); *D21B 1/04* (2013.01); *D21B 1/06* (2013.01)

(58) Field of Classification Search
CPC ..... D21H 11/18; D21H 11/12; D21H 11/20; D21B 1/04; D21B 1/06; C08B 15/02; C08B 15/08; C08L 1/02
See application file for complete search history.

(56) References Cited

U.S. PATENT DOCUMENTS 4,374,702 A 2/1983 Turbak et al.
4,487,634 A * 12/1984 Turbak ..... A61K 8/027 106/163.01
4,500,546 A * 2/1985 Turbak ..... A61K 8/027 514/781
5,694,983 A 12/1997 Kusakari et al.
5,964,983 A * 10/1999 Dinand ..... C09K 8/206 162/187
6,183,596 B1 2/2001 Matsuda
10,053,817 B2 * 8/2018 Gane ..... D21H 17/675
10,100,467 B2 * 10/2018 Gane ..... D21C 9/007
10,273,634 B2 * 4/2019 Hietaniemi ..... D21H 11/18
10,358,504 B2 * 7/2019 Karppi ..... C08B 15/02
2005/0194477 A1 9/2005 Suzuki
2008/0118765 A1 5/2008 Dorgan et al.
2011/0081554 A1 * 4/2011 Ankerfors ..... C09D 103/04 428/535
2012/0043039 A1 * 2/2012 Paltakari ..... D21H 17/25 162/157.6
2012/0107480 A1 * 5/2012 Gane ..... A23L 29/262 426/573
2013/0000855 A1 * 1/2013 Nuopponen ..... D21H 21/30 162/76
2013/0202870 A1 * 8/2013 Malmborg ..... C08K 7/02 428/220
2013/0203981 A1 * 8/2013 Dahl ..... C08B 15/02 536/56
2013/0209772 A1 * 8/2013 Sandstrom ..... D21H 11/18 428/220
2014/0079931 A1 * 3/2014 Berglund ..... C12P 19/14 428/219
2014/0179912 A1 * 6/2014 Rasanen ..... C08H 8/00 536/56
2014/0200335 A1 7/2014 Olkowski
2015/0307692 A1 * 10/2015 Kamal ..... F26B 5/06 523/218
2015/0330024 A1 * 11/2015 Gane ..... D21H 11/18 162/149
2017/0313788 A1 * 11/2017 Lillandt ..... C08B 15/08
2019/0040581 A1 * 2/2019 Vanhatalo ..... D21B 1/04
2020/0347552 A1 * 11/2020 Karisalmi ..... D21H 17/33

FOREIGN PATENT DOCUMENTS

CN 102317542 A 1/2012
CN 103168129 A 6/2013
EP 2386682 A1 * 11/2011 ..... D21H 11/18
(Continued)

OTHER PUBLICATIONS

Machine Translation of JP 59-120638 A (Year: 1984).*
Wetterling Effect of surface structure on the filtration propertioes of microcrystalline sellulose, Separation and Publication Technology vol. 136 (2014), p. 3-9 XP029084643.
Kleinebudde Influence of degree of polymerization on behavior of cellulose during homogenization and exrusion/spheronization, AAPS Pharmci 2000, published Jul. 21, 2000.
Lee Preparation of cellulose nanofibrils by high-pressure homogenizer and cellulose-based composite films; Journal of Industrial and Engineering Chemistry 15 (2009), pp. 50-55.
Search report of FI20165074 issued by Finnish Patent and Registration Office, dated Oct. 21, 2016.
Search report of PCT/FI2016/050916 issued by European Patent Office dated Mar. 27, 2017.
Papadopoulos, A.N. et al.: "Determination of surface area and pore volume of holocellulose and chemically modified wood flour using the nitrogen adsoption technique", Holz als Roh-und Werkstoff 61 (2003), pp. 453-456, Springer-Verlag, DOI 10.1007/s00107-003-0430-5.
(Continued)

*Primary Examiner* — Jose A Fortuna
(74) *Attorney, Agent, or Firm* — Berggren LLP

(57) ABSTRACT

The present invention relates to a method of producing microfibrillated cellu-lose (MFC) comprising (i) providing cellulosic material, (ii) drying the cellulosic material so that specific surface area (SSA), when measured with BET-method, is at most 10 $m^2/g$, and (iii) subjecting the dried cellulosic material to mechanical treatment. The present invention additionally relates to microfibril-lated cellulose produced with the method of the present invention.

14 Claims, No Drawings

(56) References Cited

FOREIGN PATENT DOCUMENTS

| | | | | | |
|---|---|---|---|---|---|
| JP | S59 120638 | A | | 7/1984 | |
| WO | 2007091942 | A1 | | 8/2007 | |
| WO | 2010092239 | A1 | | 8/2010 | |
| WO | 2011095335 | A1 | | 8/2011 | |
| WO | WO-2011134939 | A1 | * | 11/2011 | ..... D21C 9/007 |
| WO | 2011/147825 | A1 | | 12/2011 | |
| WO | 2011154599 | A1 | | 12/2011 | |
| WO | 2012045298 | A2 | | 4/2012 | |
| WO | 2014029909 | A1 | | 2/2014 | |
| WO | 2014087052 | A1 | | 6/2014 | |
| WO | 2014202354 | A1 | | 12/2014 | |
| WO | 2015074120 | A1 | | 5/2015 | |
| WO | 2015166141 | A1 | | 11/2015 | |
| WO | WO-2017134334 | A1 | * | 8/2017 | ..... D21B 1/04 |

OTHER PUBLICATIONS

European Patent Office, office action of European patent application No. 16829255.5, dated Jul. 4, 2019, 2 pages.
Dr. George et al., Avicel PH Microcrystalline Cellulose, NF, Ph Eur., JP, BP, Manufacturing Process, Jan. 1, 2000, 27 pages.
Steele, Fraser D. et al., Surface Energy of Microcrystalline Cellulose Determined by Capillary Intrustion and Inverse Gas Chromatography, The AAPS Journal, Oct. 8, 2008, pp. 494-503, vol. 10 No. 3.

* cited by examiner

PROCESS FOR PRODUCING MICROFIBRILLATED CELLULOSE AND A PRODUCT THEREOF

PRIORITY

This application is a U.S national application of the international application number PCT/FI2016/050916 filed on Dec. 22, 2016 and claiming priority of Finnish national application FI20165074 filed on Feb. 3, 2016, the contents of both of which are incorporated herein by reference.

FIELD OF THE INVENTION

The present invention relates to a method for manufacturing microfibrillated cellulose (MFC) and to a product thereof.

BACKGROUND ART

Microfibrillated cellulose (MFC), also called cellulose nanofibrils (CNF), is produced from various fibre sources comprising cellulosic structures, such as wood pulp. As the secondary cell walls of wood are rich in cellulose, wood pulp is commonly used as raw material for microfibrillated cellulose or nanocellulose. The MFC fibrils are isolated from the fibers usually by mechanical means such as by using high-pressure homogenizers.

The homogenizers are used to delaminate the cell walls of the fibers and liberate the microfibrils and/or nanofibrils. The application of homogenizers usually requires to pass a suspension of cellulose in a medium, for example water, the so-called pulp, several times through said homogenizers to increase the specific surface area (SSA) in order to develop an succeedingly expanding fibrillar structure reflected e.g. as an increased gel strength that will level-off at some point.

Pre-treatments are sometimes used in the production of MFC. Examples of such pre-treatments are enzymatic/mechanical pre-treatment and introduction of charged groups e.g. through carboxymethylation or TEMPO-mediated oxidation.

Microfibrillated cellulose comprises liberated semi-crystalline nanosized cellulose fibrils having high length to width ratio. A typical nanosized cellulose fibril has a width of 5-60 nm and a length in a range from tens of nanometres up to several hundred micrometres.

US 2005/0194477 A1 discloses a method for producing MFC, which comprises subjecting a slurry containing a pulp having a solid concentration (content) of 1 to 6 weight % to treatment with a disc refiner.

U.S. Pat. No. 6,183,596 discloses a process wherein a pulp slurry is firstly microfibrillated with a rubbing apparatus, and is subsequently super microfibrillated under high pressure by a two-discs-homogenizer.

U.S. Pat. No. 5,964,983 discloses a method for producing MFC, wherein a cellulose pulp at concentration of 2% is fed through a homogenizer wherein the suspension is subjected to a pressure drop which is between 20 MPa and 100 MPa and high-speed shear action followed by a high-speed deceleration impact.

WO 2007/091942 A1 discloses a method for manufacturing microfibrillated cellulose by refining a hemicelluloses containing pulp, preferably sulphite pulp, and treating the pulp with a wood degrading enzyme followed by homogenizing the pulp.

Even though there are a wide variety of methods for producing microfibrillated cellulose, there is still a need for a novel and more efficient method for producing microfibrillated cellulose.

SUMMARY OF THE INVENTION

An object of the present invention is to provide a method for manufacturing microfibrillated cellulose (MFC).

A further object of the present invention is to provide a method for manufacturing MFC, wherein manufacturing process efficiency is enhanced.

Yet, a further object of the present invention is to provide a method for manufacturing MFC, wherein the process provides more efficient disintegration into fibril structures.

Yet, a further object of the present invention is to provide a method for manufacturing MFC which is more cost-efficient.

Yet, another further object of the present invention is to provide high quality MFC.

It has now been surprisingly found that high quality MFC can be manufactured by performing rapid drying of cellulosic material, such as microcrystalline cellulose (MCC), before treating the cellulosic material mechanically, such as by fluidization or homogenization. By performing rapid drying, such as spray drying, of cellulosic material subsequent mechanical treatment efficiency is enhanced. A rapid drying step will induce hornification and structural rearrangements of the cellulosic material that induces strains in the cellulosic structure. These effects can be observed e.g. as smaller particles of higher density and smaller specific surface are (SSA). This type of drying pre-treatment was shown to provide a more efficient disintegration into fibril structures in a subsequent mechanical treatment step.

The present invention provides a method for manufacturing microfibrillated cellulose (MFC).

The present invention additionally provides microfibrillated cellulose (MFC).

DETAILED DESCRIPTION

According to the first aspect of the present invention there is provided a method for manufacturing microfibrillated cellulose (MFC). More particularly there is provided a method of producing microfibrillated cellulose (MFC) comprising (i) providing cellulosic material; (ii) drying the cellulosic material so that specific surface area (SSA), when measured with BET-method, of the cellulosic material is at most 10 $m^2/g$; and (iii) subjecting the dried cellulosic material to mechanical treatment.

The cellulosic material may be wood plant material or non-wood plant material, or a mixture thereof.

The wood plant material may be softwoods or hardwoods, or a mixture thereof. Examples of the non-wood plant material are cotton, grass, bagasse, straws of grain crops, flax, hemp, sisal, abaca or bamboo, or a mixture thereof.

In one embodiment the cellulosic material is pulp, preferably selected from mechanical pulp, thermomechanical pulp, chemi-thermomechanical pulp, chemical pulp, recycled pulp, or a mixture thereof. Examples of suitable specific pulps are sulphite pulp, sulphate pulp, soda pulps, kraft pulp, soda-AQ pulp, neutral sulphite pulp, acid sulphite pulp, organosolv pulp, or a mixture thereof, preferably kraft pulp. The cellulosic material may be bleached, half-bleached or unbleached pulp.

In one embodiment the cellulosic material is fibrous cellulosic material, particulate cellulosic material, or a mixture thereof. Preferably the cellulosic material is particulate cellulosic material and more preferably microcrystalline cellulose (MCC). As the MCC is particulate material, not fibrous, it is easier to mechanically treat the MCC than a fibrous cellulosic material, for example a homogenizator does not clog as easily as with high-aspect ratio or fibrous material.

Microcrystalline cellulose (MCC) is purified, partially depolymerized cellulose prepared by treating alpha-cellulose, obtained as a pulp from fibrous plant material, with mineral acids. The degree of polymerization is typically less than 400. Microcrystalline cellulose has typically diameter (d) greater than 1 μm and length (L) greater than 1 μm. Aspect ratio (L/d) is typically ~1-10. Not more than 10% of the material has a particle size of less than 5 μm Microcrystalline cellulose can be produced with any known method in the art. As an example, document WO 2011/154600 discloses a process for MCC production comprising i) hydrolyzing fibrous cellulosic material with an acid at an elevated temperature, or ii) acidifying fibrous cellulosic material followed by washing and hydrolyzing the washed cellulosic material at an elevated temperature to produce a microcellulose—hydrolysate mixture followed by separation of the microcellulose from the hydrolysate. MCCs are also commercially available.

The cellulosic material is dried until specific surface area (SSA) of the cellulosic material is below 10 $m^2/g$, preferably below 5 $m^2/g$, more preferably below 3 $m^2/g$ when measured with BET-method.

The SSA is calculated by the Brunauer-Emmett-Teller (BET-method) equation from $N_2$-sorption isotherms. In the BET-method, to determine the SSA, wet cellulosic material samples were subjected to two-step liquid-displacement using a fully water-soluble low-molecular alcohol, frozen and allowed to sublimate in freeze-dry conditions. The SSA were analyzed using a NOVA 4000 (Quantachrome GmbH & Co., Odelzhausen, Germany) and pure $N_2$ gas to provide adsorption isotherms. On the basis of the isotherm data, the SSA was calculated by the Brunauer-Emmett-Teller (BET) equation.

In one embodiment the cellulosic material is dried by conduction. Any suitable method can be used in conduction drying, such as a paddle dryer.

In a preferred embodiment the cellulosic material is dried by bringing it in contact with heated gas. The heated gas can be any suitable gas or a mixture of gases that is capable of drying the cellulosic material.

By term "heated gas" is meant gas that has a temperature above room temperature. Preferably the temperature of the heated gas is above temperature of the cellulosic material that is to be dried.

In one embodiment the heated gas has a temperature above 25° C., preferably from 30° C. to 800° C., more preferably from 100° C. to 700° C.

Examples of suitable heated gases are air, an inert gas such as argon and nitrogen, and steam, or mixtures thereof. Preferred heated gas is air. Air is most economic and safest to use.

The drying can be any suitable drying method that is capable of drying the cellulosic material rapidly. Examples of such drying methods are spray drying, flash drying, fluid bed drying and rotary drum drying. Preferably the drying method is spray drying or flash drying, more preferably spray drying. In the spray drying the cellulosic material, such as the MCC, that is dried stays in motion and thus the cellulosic material, such as the MCC particles, stays dispersed while not forming larger agglomerates.

In one embodiment inlet temperature of the heated gas in the spray drying is from 200° C. to 450° C., preferably from 250° C. to 400° C. such as 350° C., and outlet temperature from 50° C. to 150° C., preferably from 60° C. to 120° C., more preferably from 60° C. to 100° C. such as 90° C.

In one embodiment inlet temperature of the heated gas in the flash drying is from 150° C. to 700° C.

Drying time in the drying step can be any suitable time period that is long enough to dry the cellulosic material sufficiently. The drying time depends on i.a. the water content of the cellulosic material, temperature of the heated gas, drying method, particle size of the dried material and desired water content of the dried cellulosic material. A skilled person is capable of determine suitable drying time.

In one embodiment the effective drying time is less than 20 min, preferably less than 10 min, more preferably less than 5 min, even more preferably less than 5 min.

In one embodiment where the drying is spray drying or flash drying the drying time is preferably from 1 s to 60 s, more preferably from 5 s to 30 s.

In one preferred embodiment the water content of the dried cellulosic material is from 1 wt. % to 20 wt. %, preferably from 2 wt. % to 15 wt. %, more preferably from 5 wt. % to 10 wt. %.

In one embodiment size, length, of the dried cellulosic material, preferably MCC, is less than 50 μm, preferably less than 40 μm, more preferably from 10 μm to 35 μm, and most preferably from 20 μm to 30 μm.

In other embodiment the dried cellulosic material has D50 average particle size of from 1 μm to 150 μm, preferably from 2 μm to 100 μm, more preferably from 20 μm to 70 μm. The particle sizes were measured with Mastersizer method, in which the particles sizes were measured with a Mastersizer 2000 equipped with a Hydro 2000MU dispersion unit (Malvern Instrument Ltd, United Kingdom). The size distribution d50 value was used as a measure of the average particle size. In the measurement, about 0.5 g of the sample was mixed to 25.0 mL of water using a dispersion unit at 800 rpm stirring rate. Next the suspension was ultrasonicated for 60 s with an amplitude of 39% and frequency of 20 Hz. A fully disintegrated sample (5 mL) was pipetted into the dispersion unit and the particle size distribution was measured by three sequential five-second measurements at 60-second intervals. The background signal measurement was done with distilled water each time prior to sample measurement.

The dried cellulosic material is subjected to mechanical treatment.

The mechanical treatment may be any suitable mechanical treatment known in the art that refines the cellulosic material to microfibrillated cellulose (MFC).

Examples of suitable mechanical treatments are fibrillation in a grinder, comminutor, extruder, rotor-stator mixer or grinder, rotor-rotor mixer or grinder, high-shear rate grinder, dispersionizers, homogenizer, fluidizer or ultrasonic disintegrator.

In a preferred embodiment the dried cellulosic material is subjected to treatment in a fluidizer or a homogenizer, preferably a fluidizer.

All conventional homogenizers and fluidizers available may be used, such as Gaulin homogenizer or microfluidizer. The homogenization or fluidization may be performed under the influence of a pressure difference. During homogenization or fluidization the mixture comprising natural cellulose fibres is subjected to high pressure, for example of 200-2100 bar. For example, in homogenization the mixture comprising natural cellulose fibres and an optional additive may be pumped at high pressure, as defined above, and fed through a spring-loaded valve assembly. The natural cellulose fibers in the mixture are subjected to a large pressure drop under high shearing forces. This leads to fibrillation of the natural cellulose fibers. Alternatively, in fluidization homogenization the mixture comprising natural cellulose fibres and an optional additive passes through Z-shaped channels under high pressure, as defined above. The channel diameter may be 200-400 μm. The shear rate, which is applied to the natural cellulose fibres in the mixture is thus high, and results in the formation of cellulose microfibrils. Irrespective of the procedure, i.e. homogenization or fluidization, the procedure may be repeated several passes until the desired degree of fibrillation is obtained.

The mechanical treatment can be performed in pressurized conditions, for example in homogenizer or fluidizer. In one embodiment pressure in the homogenizer or in the fluidizer is from 200 bar to 2100 bar, preferably from 400 bar to 1500 bar, more preferably from 500 bar to 1100 bar.

The dried cellulosic material may be passed through the homogenizer or fluidizer as many times as needed in order to obtain MFC with desired features. In preferred embodiment the cellulosic material is passed through the homogenizer or fluidizer from 1 to 5 pass(es).

The dried cellulosic material may be fed to the mechanical treatment as such or as an aqueous suspension. In one embodiment the dried cellulosic material is fed to the mechanical treatment at a feed consistency of from 1 wt. % to 70 wt. %, preferably from 1 wt. % to 50 wt. %, more preferably from 1 wt. % to 20 wt. %, even more preferably from 1.5 wt. % to 10 wt. %, and most preferably from 6 wt. % to 8 wt. %, in dry solids content.

The method of the present invention may optionally also comprise one or more pre-treatments before the drying step. Examples of such pre-treatments are hydrolysis such as acid hydrolysis, enzymatic and/or mechanical pre-treatment, or introduction of charged groups e.g. through carboxymethylation or TEMPO-mediated oxidation.

Obtained microfibrillated cellulose (MFC) may be in solid form or in a form of a gel-like suspension comprising MFC, depending on the mechanical treatment method. Optionally the MFC may be further treated. One example of such a treatment is drying.

The term "microfibrillated cellulose" (MFC) as used in this specification includes microfibrillated/microfibrillar cellulose and nanofibrillated/nanofibrillar cellulose (cellulose nanofibrils), materials that are also referred to as nanocellulose.

According to the second aspect of the present invention there is provided microfibrillated cellulose (MFC). More particularly there is provided microfibrillated cellulose (MFC) that is produced with the method of the present invention.

The microfibrillated cellulose (MFC) of the present invention has a specific surface area (SSA) ($m^2/g$) larger, preferably at least 5% larger, more preferably at least 10% larger compared to a MFC that is not produced with the method of the present invention.

The method used for determining SSA ($m^2/g$) of the respective materials was described in detail earlier.

In one embodiment the MFC of the present invention has SSA ($m^2/g$) over 110 $m^2/g$, preferably over 110 $m^2/g$ after 5 passes through a fluidizer, more preferably over 110 $m^2/g$ after 5 passes through a fluidizer processed at a fluidization consistency of 7.5 wt. %.

In other embodiment the MFC has diameter (d) of from 10 nm to 40 nm. Yet in other embodiment the MFC has length (L) more than 1 μm. Yet in another embodiment the MFC has aspect ratio (length/diameter (L/d)) from 10 to 300.

The microfibrillated cellulose (MFC) of the present invention or the microfibrillated cellulose (MFC) produced with the method of the present invention may be used in pulp or paper applications or processes.

The microfibrillated cellulose (MFC) of the present invention or the microfibrillated cellulose (MFC) produced with the method of the present invention may be also used in oil drilling applications, food applications, pharmaceutical applications, cosmetic applications or coating applications.

The microfibrillated cellulose (MFC) of the present invention or the microfibrillated cellulose (MFC) produced with the method of the present invention may be used as an emulsion agent, a stabilizing agent, reinforcing agent, a barrier agent, a pharmaceutical or nutraceutical excipient.

In the following the invention will be described in more detail by means of examples. The purpose of the examples is not to restrict the scope of the claims.

Examples

Materials

A cotton-derived commercial microcrystalline cellulose (MCC) Avicel PH-101 ("Avicel" in the following), purchased from Sigma-Aldrich (Germany), was used as such.

Two different softwood chemical pulps were used for preparation of the other raw materials: a bleached sulfate pulp (from a Central Finnish pulp mill) for the MCC and a bleached sulfite pulp (Domsjö ECO Bright, Domsjö Fabriker AB, Sweden) for the reference material. The employed sulfuric and citric acids, and disodium hydrogen phosphate were all laboratory grade and used without further purification. The commercial endoglucanase enzyme used was EcoPulp R® (RAOL Oyj, Finland) with an activity of 152000 CMU/g. The enzyme solution was diluted prior to hydrolysis. Distilled water was used in all laboratory procedures.

Methods

Preparation of a Reference Raw Material (Reference Sample)

The reference raw material ("Ref." in the following) was prepared from a commercial bleached softwood sulfite pulp was refined to a Schopper-Riegler value of 28° by PFI milling, employing the standards ISO 5264-2:2011 and ISO 5267-1:1999. The subsequent enzymatic treatment was done with an enzyme charge of 500 CMU/g at 50° C. at 4% cellulose consistency and gentle spoon mixing every 20 min for 2 h 20 min. The treatment was done in citric acid (0.1 M) and a disodium hydrogen phosphate (0.2 M) buffer solution by adjusting the pH to 4.8. After the incubation period the fibres were washed in a Büchner funnel until wash filtrate conductivity was 5 μS. The enzymatic activity was discontinued by incubating the 4% pulp at 90° C. for 30 min with a subsequent washing step. Finally the pulp was mechanically refined to a Schopper-Riegler value of 85° in a PFI mill, according to ISO 5264-2:2011 and ISO 5267-1:1999.

Preparation of Cellulosic Raw Material: Microcrystalline Cellulose (MCC) Raw Material In order to manufacture the MCC raw materials, a bleached softwood sulfate pulp was hydrolyzed in a tube-like 2.5 $dm^3$ metal reactor by using $H_2SO_4$ as hydrolyzing agent. The hydrolyzation was done with a 1.5% acid charge (calculated on the basis of oven-dry cellulose) at 160° C. with a 10% pulp consistency. Hydrolysis was ended when degree of polymerization (DP) level of 390 was reached by cooling the reactors to room temperature and washing the produced MCC in a Büchner funnel on 90-mesh wire.

MCC Reference Sample

The above produced MCC is a never-dried MCC product which was used as such as a reference sample in preparation of microfibrillated cellulose (MFC) (referred to as "DP390" in the following).

Dried MCC Sample; Drying of MCC (According to the Present Invention)

Part of the above produced MCC was converted to dry powder (referred to as "DP390dry" in the following) by spray drying (Niro Mobile Minor, Niro Atomizer Ltd., Copenhagen, Denmark) at 5% feed consistency using inlet and outlet air temperatures of 350° C. and 90° C., respectively. The obtained dried MCC sample was used as such.

Characterization of the MCC Samples

The particle sizes of Avicel, DP390 and DP390dry were measured with a Mastersizer 2000 equipped with a Hydro 2000MU dispersion unit (Malvern Instrument Ltd, United Kingdom). The size distribution d50 value was used as a measure of the average particle size. About 0.5 g of the sample was mixed to 25.0 mL of water using a dispersion unit with a 800 rpm stirring rate. Next the suspension was ultrasonicated for 60 s with an amplitude of 39% and frequency of 20 Hz. A fully disintegrated sample (5 mL) was pipetted into the dispersion unit and the particle size distribution was measured by three sequential five-second measurements at 60-second intervals. The background signal measurement was done with distilled water each time prior to sample measurement.

The DP was calculated from the intrinsic viscosities of the cellulose raw materials, dissolved in cupriethylenediamine and measured according to SCAN-C 15:99. The calculation was done according standard SCAN-C 15:88 Mark-Houwink equation In Table 1 are presented particle sizes of the MCC raw materials before subjecting the MCCs to fluidizer treatment (preparation of MFC).

TABLE 1

The raw materials' molecular, structural and visual characteristics

| Raw material | DP | Weight average molecular weight (kg/mol) | Average particle size (μm) | Visual particle surface characteristics |
|---|---|---|---|---|
| Ref. | 1311 | 459 | 800 | Fibrous, disintegrated, fibrils |
| Avicel | 264 | 62 | 58.4 | Cubic, solid, smooth |
| DP390 | 392 | 156 | 64.6 | Oblong, fibrils, "hairy" |
| DP390dry | 389 | 158 | 26.3 | Oblong, smooth |

It can be seen from Table 1 that the MCC dried according to the present invention (sample DP390dry) has smallest average particle size. That is, the rapid drying, spray drying, reduces the particle size.

Preparation of Micro Fibrillated Cellulose (MFC)

The Microfluidizer equipment (Microfluidizer M-110P, Microfluidics Corp.) was employed to prepare all MFCs. The fluidizer was equipped with two Y-shaped impact chambers connected in series. The internal diameter of the first impact chamber flow channel was 200 μm and the second 100 μm. The used production pressure was 2000 bar. After each pass through the impact chambers a MFC sample was taken for further analyses. The maximum number of passes was five. Various feed consistency levels for each raw material (reference sample, Avicel (reference sample), DP390 (reference sample) and DP390dry) were tried, but maximum consistency levels were determined according to the following criterion: operation of the fluidizer equipment was smooth and trouble-free, implying no flocculation, clogging or other processing problems. The used and maximum applicable feed consistencies for the different raw materials are listed in Table 2.

TABLE 2

The tested and utilized fluidizer feed consistencies of the different cellulose raw materials

| Sample | Fluidization consistency (%) | | | | |
|---|---|---|---|---|---|
| Ref. | 1.5 | N/A | N/A | N/A | N/A |
| DP390 | 1.5 | 3.0 | 4.5 | N/A | N/A |
| Avicel | 1.5 | 3.0 | 4.5 | 6.0 | 7.5 |
| DP390dry | 1.5 | 3.0 | 4.5 | 6.0 | 7.5 |

N/A = not processable due to operational problems

Characterization of the Prepared MFC Samples

Specific surface area (SSA) of all samples were analyzed using a NOVA 4000 (Quantachrome GmbH & Co., Odelzhausen, Germany) and pure $N_2$ gas to provide adsorption isotherms. On the basis of the isotherm data, the samples' SSA was calculated by the Brunauer-Emmett-Teller (BET) equation. Wet MFC samples were subjected to two-step liquid-displacement using a fully water-soluble low-molecular alcohol, frozen and allowed to sublimate in freeze-dry conditions.

The measured BET data (Table 3) indicated that the fluidization process conditions imposed significant effects on the resulting MCC structure. When comparing the SSAs of raw material and fibrillated cellulose it was apparent that the MFC produced from dry MCC (DP390dry and Avicel) produced a larger increase in SSA than in the case of never-dried MCC (DP390). Moreover it was apparent that the Ref. raw material showed the largest raw material surface area and further processing did not increase this. The data in Table 3 show that a higher consistency in fluidization consequently resulted in MFC with higher surface area.

As can also been see from Table 3, with the method of the present invention MFC (sample DP390dry) with high SSA is obtained compared to the reference samples (Ref., Avicel and DP390). Thus, the rapid drying (spray drying) of the MCC material affects the properties of the final MFC.

TABLE 3

BET/SSA data.

| Feed material | Fluidization Consistency | BET-area (m2/g) Passes 0 | BET-area (m2/g) Passes 5 |
|---|---|---|---|
| Ref. | 1.5 | 40.2 | 49.7 |
| Avicel (MCC, dry; | 1.5 | 0.9 | 66.1 |
| Reference) | 7.5 | 0.9 | 107.7 |
| DP390 (MCC, never | 1.5 | 13.1 | 79.9 |
| dried; Reference) | 4.5 | 13.1 | 94.1 |
| DP390dry | 1.5 | 1.0 | 83.1 |
| | 7.5 | 1.0 | 113.5 |

The invention claimed is:

1. A method of producing microfibrillated cellulose (MFC) comprising:

(i) providing a cellulosic material, which is microcrystalline cellulose, (ii) drying the cellulosic material by spray drying, flash drying, fluid bed drying or rotary drum drying, wherein the drying time is less than 5 minutes, until a specific surface area (SSA), when measured with Brunauer-Emmett-Teller (BET)-method, of the cellulosic material is at most 10 $m^2/g$, and a size of the dried cellulosic material is less than 50 μm, and (iii) subjecting the dried cellulosic material to mechanical treatment, which refines the cellulosic material to microfibrillated cellulose.

2. The method according to claim 1, wherein the cellulosic material is dried by bringing it in contact with heated gas.

3. The method according to claim 2, wherein the heated gas is air, an inert gas, or steam.

4. The method according to claim 1, wherein drying time is from 1 s to 60 s.

5. The method of claim 4, wherein the drying time is 5-30s.

6. The method according to claim 1, wherein the drying is spray drying and inlet temperature in the spray drying is from 200° C. to 450° C., and outlet temperature from 50° C. to 150° C.

7. The method according to claim 1, wherein water content of the dried cellulosic material is from 1 wt. % to 20 wt. %.

8. The method of claim 7 wherein water content of the dried cellulosic material is from 2 wt. % to 15 wt. %.

9. The method according to claim 1, wherein the dried cellulosic material is fed to the mechanical treatment at a feed consistency of from 1 wt. % to 70 wt. % in dry solids content.

10. The method according to claim 1, wherein the mechanical treatment is selected from fibrillation in a grinder, comminutor, extruder, rotor-stator mixer or grinder, rotor-rotor mixer or grinder, high-shear rate grinder, dispersionizers, homogenizer, fluidizer or ultrasonic disintegrator.

11. The method according to claim 1, wherein the mechanical treatment is conducted by a homogenizer or a fluidizer.

12. The method according to claim 11, wherein pressure in the homogenizer or in the fluidizer is from 200 bar to 2100 bar.

13. The method according to claim 11, wherein the dried cellulosic material is passed through the homogenizer or fluidizer from 1 to 5 pass(es).

14. The method according to claim 1, wherein the inlet temperature in the spray drying is from 250° C. to 400° C., and outlet temperature from 60° C. to 120.

* * * * *